US006837639B2

(12) United States Patent
Hui

(10) Patent No.: US 6,837,639 B2
(45) Date of Patent: Jan. 4, 2005

(54) ILLUMINABLE WRITING INSTRUMENT

(76) Inventor: Ve-Chung Hui, Rm. 1004-1007, 10/F, Hong Man Industrial Centre, 2 Hong Man Street, Chai Wan (HK)

( * ) Notice: Subject to any disclaimer, the term of this patent is extended or adjusted under 35 U.S.C. 154(b) by 108 days.

(21) Appl. No.: 10/442,018

(22) Filed: May 19, 2003

(65) Prior Publication Data

US 2004/0234325 A1 Nov. 25, 2004

(51) Int. Cl.[7] ..... B43K 29/00; B43K 5/16
(52) U.S. Cl. ..... 401/195; 401/99; 362/118
(58) Field of Search ..... 401/195, 52, 99; 362/118, 109, 119

(56) References Cited

U.S. PATENT DOCUMENTS 5,275,497 A * 1/1994 Shiau ..... 401/195
5,470,164 A * 11/1995 Chen ..... 401/195
5,570,967 A * 11/1996 Chen ..... 401/195
5,803,583 A * 9/1998 Hsieh ..... 362/118
6,585,388 B2 * 7/2003 Kim ..... 362/118

* cited by examiner

*Primary Examiner*—David J. Walczak
(74) *Attorney, Agent, or Firm*—Raymond Y. Chan; David and Raymond Patent Group

(57) ABSTRACT

An illuminable writing instrument includes a hollow elongated body having a first end, an opposed second end, and a receiving cavity, wherein the elongated body is adapted for a light passing from the receiving cavity to outside, a writing unit, having a writing tip, disposed in the receiving cavity, an actuator mounted at the second end of the elongated body to move the writing unit from a normal unemployed position to an operation position, and an illumination arrangement including an illuminating unit supported within the receiving cavity of the elongated body and a switch control which is electrically connected to the illuminator and is arranged to activate the illuminating unit for providing a lighting effect throughout the elongated body while actuating the writing unit via the actuator.

19 Claims, 4 Drawing Sheets

ILLUMINABLE WRITING INSTRUMENT

BACKGROUND OF THE PRESENT INVENTION

1. Field of Invention

The present invention relates to a writing instrument, and more particularly to an illuminable writing instrument which comprises an illumination arrangement for providing an added lighting effect to the writing instrument so as to not only enhance the aesthetic appearance of the writing instrument but also facilitate the practical use thereof.

2. Description of Related Arts

A pen is a common tool that replaces pencils as a writing instrument wherein the pen comprises a hollow pen holder and a pen core disposed along the pen holder. Generally, there are two types of pen, namely a mechanical pen and a disposable pen that the pen core is irreplaceable such that the disposable pen must be thrown away when the ink of the pen core is used up.

Accordingly, the pen core is replaceable for the mechanical pen, wherein the mechanical pen further comprises an actuating unit provided on the pen holder to move the pen core between an operation position and a storage position, wherein at the operation position, a writing tip of the pen core is pushed out of an end of the pen holder and at the storage position, the writing tip of the pen core is received within the pen holder.

In order to enhance the attraction of the pen, the pen, as disclosed in the U.S. Pat. No. 6,099,185, further comprises an illumination unit operatively incorporated with the pen holder to provide an added lighting effect for the pen. However, such light pen has several drawbacks.

Due to the limited size of the pen, when the illumination unit is mounted at the tail end of the pen holder, the length of the pen holder must be substantially shortened. In other words, the size of the pen core must be reduced to fit into the pen holder. Therefore, less amount of ink can be filled in the pen core so as to shorten the service life span of the pen and highly increase the maintenance cost of the pen to refill the pen core.

In addition, the illumination unit comprises a switch to activate the LED which results in the illumination of the illumination unit to provide the lighting effect for the pen. However, the actuation of the illumination unit is independent that the pen holder must incorporate with another mechanism to actuate the pen core. Therefore, the user may merely operate two different actions to switch on the illumination unit and actuate the pen core to its operation position individually.

Furthermore, such light pen discloses that the illumination unit can be detached from the pen holder to function as a flashlight. However, in accordance with the structural design, the light pen can be simply considered as a flashlight detachably mounted to a regular mechanical pen since the lighter requires two individual actuations to operate the illumination unit and the pen core respectively.

SUMMARY OF THE PRESENT INVENTION

A main object of the present invention is to provide an illuminable writing instrument which comprises an illumination arrangement for providing an added lighting effect to the writing instrument so as to not only enhance the aesthetic appearance of the writing instrument but also facilitate the practical use thereof.

Another object of the present invention is to provide an illuminable writing instrument, the actuation of the illuminable writing instrument of the present invention requires a simple single-action operation to actuate both the writing unit and the illumination arrangement instead of the conventional two individual operations.

Another object of the present invention is to provide an illuminable writing instrument, wherein the illumination arrangement is adapted to be installed to all kinds of the conventional mechanical pen.

Another object of the present invention is to provide an illuminable writing instrument, which does not require to alter the original structural design of the writing instrument, so as to minimize the manufacturing cost of incorporating the illumination arrangement with every conventional mechanical pen.

Another object of the present invention is to provide an illuminable writing instrument, wherein no expensive or complicated structure is required to employ in the present invention in order to achieve the above mentioned objects. Therefore, the present invention successfully provides an economic and efficient solution not only for providing an added lighting effect to enhance the aesthetic appearance of the writing instrument but to also for facilitating the practical use of the writing instrument.

Accordingly, in order to accomplish the above objects, the present invention provides an illuminable writing instrument, comprising:

- a hollow elongated body having a first end, an opposed second end, and a receiving cavity, wherein the elongated body is adapted for a light passing from the receiving cavity to outside;
- a writing unit, having a writing tip, disposed in the receiving cavity;
- an actuator mounted at the second end of the elongated body to move the writing unit from a normal unemployed position that the writing tip of the writing unit is received within the receiving cavity to an operation position that the writing tip of the writing unit is pushed out of the elongated body at the first end thereof; and
- an illumination arrangement comprising an illuminating unit supported within the receiving cavity of the elongated body and a switch control which is electrically connected to the illuminator and is arranged to activate the illuminating unit for providing a lighting effect throughout the elongated body while actuating the writing unit via the actuator.

These and other objectives, features, and advantages of the present invention will become apparent from the following detailed description, the accompanying drawings, and the appended claims.

DETAILED DESCRIPTION OF THE PREFERRED EMBODIMENT

Figure 1:
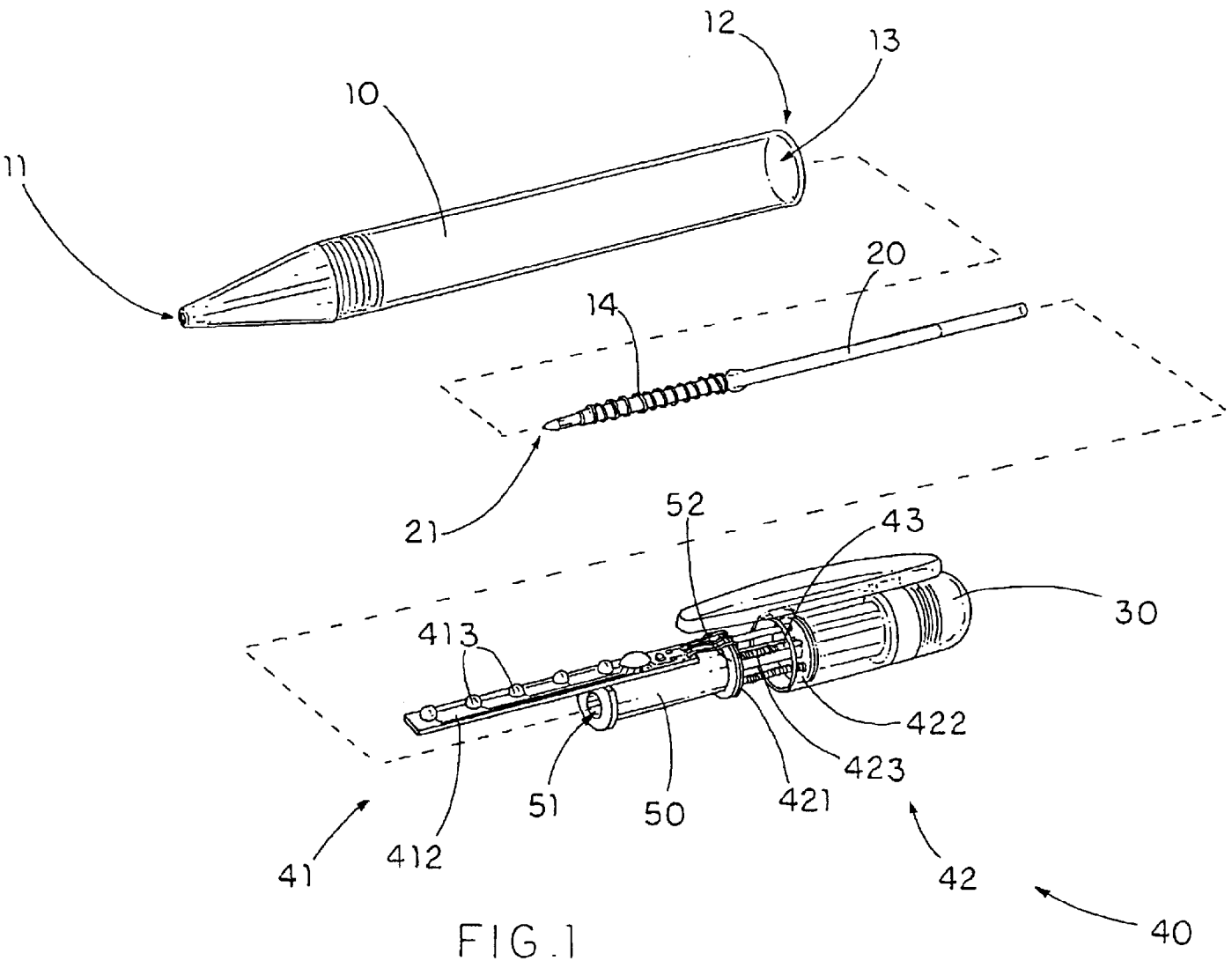
FIG. 1 is an exploded perspective view of an illuminable writing instrument according to a preferred embodiment of the present invention.

Referring to FIG. 1 of the drawings, an illuminable writing instrument according to a preferred embodiment of the present invention is illustrated, wherein the illuminable writing instrument comprises a hollow elongated body 10, a writing unit 20, and an actuator 30.

The elongated body 10 has a first end 11, an opposed second end 12, and a receiving cavity 13 extended from the first end 11 to the second end 12 wherein the elongated body 10 is adapted for a light passing from the receiving cavity 13 to outside.

The writing unit 20, having a writing tip 21, is disposed in the receiving cavity 13 of the elongated body 10 in a slidably movable manner wherein the writing tip 21 of the writing unit 20 is positioned within the receiving cavity 13 pointing towards the first end 11 of the elongated body 10.

The actuator 30 is mounted at the second end 12 of the elongated body 10 to move the writing unit 20 from a normal unemployed position that the writing tip 21 of the writing unit 20 is received within the receiving cavity 13 to an operation position that the writing tip 21 of the writing unit 20 is pushed out of the elongated body 10 at the first end 11 thereof.

Accordingly, the actuator 30 is slidably mounted at the second end 12 of the elongated body 10 in such a manner that when a pressing force is applied on the actuator 30, the actuator 30 triggers the writing unit 20 and pushes the writing unit 20 until the writing tip 21 of the writing unit is slid out of the elongated body 10 at the first end 11 thereof, i.e. the operation position of the writing unit 20.

A spring 14 is disposed in the receiving cavity 13 of the elongated body 10 and is coaxially mounted around the writing unit 20 wherein the spring 14 is arranged for applying an urging pressure against the writing unit 20 so as to push the writing tip 21 of the writing unit 20 back into the receiving cavity 13 from the operation position to the unemployed position.

The illuminable writing instrument further comprises an illumination arrangement 40 comprising an illuminating unit 41 supported within the receiving cavity 13 of the elongated body 10 and a switch control 42 which is electrically connected to the illuminator 41 and is arranged to activate the illuminating unit 41 for providing a lighting effect throughout the elongated body 10 while actuating the writing unit 20 via the actuator 30.

According to the preferred embodiment, the illuminating unit 41 of the illumination arrangement 40 comprises a power source 411 received in the receiving cavity 13 of the elongated body 10 at the second end 12 thereof, an IC board 412 extended along the receiving cavity 13 of the elongated body 10 to electrically connect to the power source 411, and at least an illuminator 413 electrically mounted on the IC board 412 in such a manner that when the illuminating unit 41 is activated via the switch control 42, the illuminator 413 is arranged for producing the lighting effect throughout the elongated body 10.

Accordingly, the IC board 412, having a predetermined length, is positioned within the receiving cavity 13 of the elongated body 10 between the first and second ends 11, 12 thereof for diffusing the lighting effect through the elongated body 10, wherein the IC board 412 is arranged to control the pattern and duration of illumination of the illuminator 413 such that the illuminator 413 is capable of producing the lighting effect along the elongated body 10 for a predetermined period of time.

Figure 2:
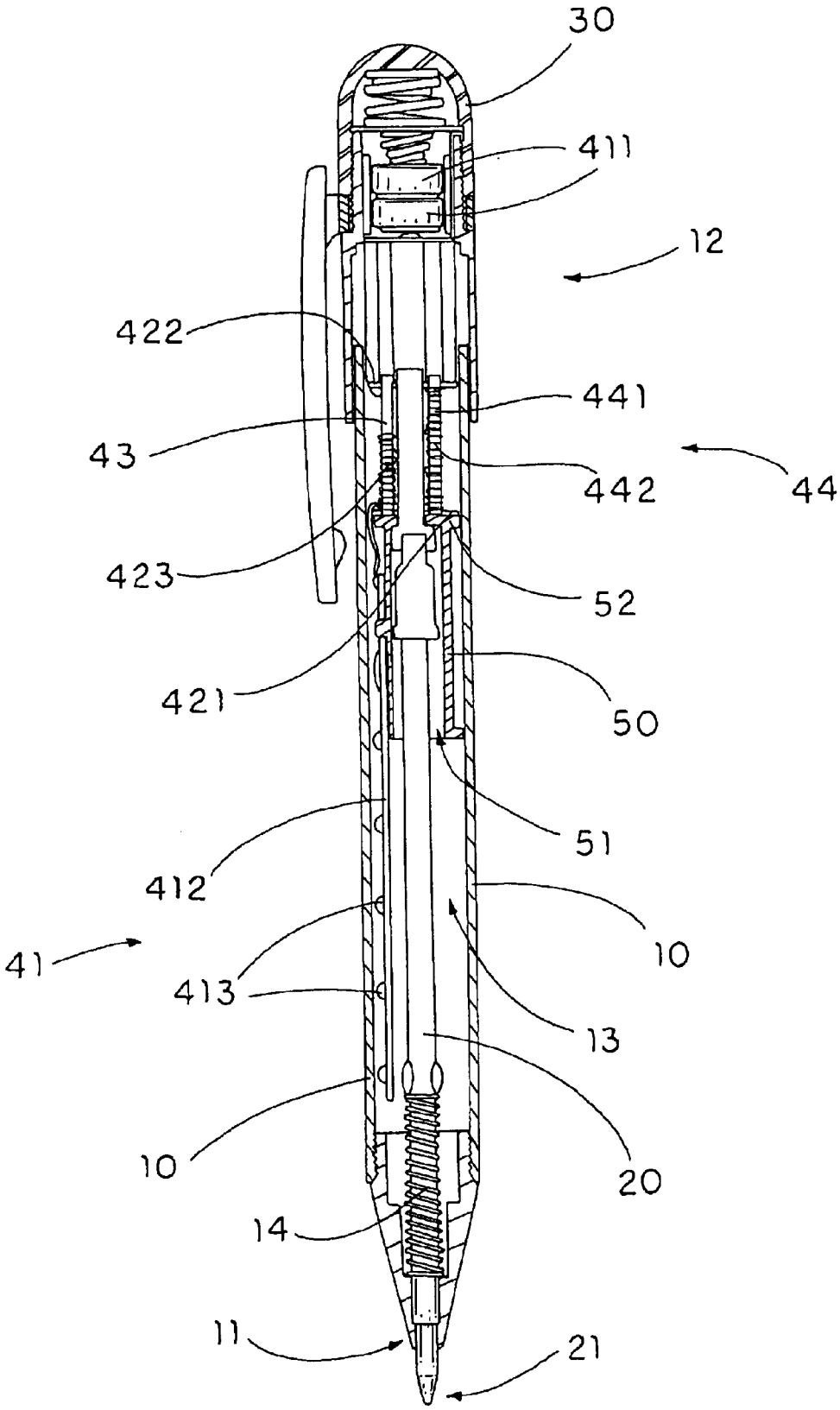
FIG. 2 is a sectional view of the illuminable writing instrument according to the above preferred embodiment of the present invention.

As shown in FIG. 2, there are a plurality of illuminators 413 alignedly mounted on the IC board 412 along the receiving cavity 13 of the elongated body 10 such that when the illuminators 413 are activated, the lights produced by the illuminators 413 are diffused throughout the elongated body 10 to enhance the aesthetic appearance of the illuminable writing instrument of the present invention. Furthermore, the illuminators 413 are LEDs aligned along the receiving cavity 13 to produce different colors and/or patterns as the lighting effect to enhance the added visibility of the present invention.

The illuminable writing instrument further comprises a supporting member 50, having a through slot 51, coaxially supported in the receiving cavity 13 of the elongated body 10 between the first and second ends 11, 12 thereof to substantially support the IC board 412 in position wherein a rear portion of the writing unit 20 is slidably passed through the through slot 51 to bias against the actuator 30. In other words, the writing unit 20 does not require to shorten its length when the illumination unit 40 is incorporated with the elongated body 10, so as to prolong the service life span of the writing unit 20.

As shown in FIG. 2, the switch control 42, which is operatively incorporated the actuator 30, comprises a first switch 421 securely supported within the receiving cavity 13 of the elongated body 10 to electrically connect with the IC board 412, a second switch 422 mounted at a bottom side of the actuator 30 to electrically connect with the power source 411, and a circuit activator 423 which is supported between the first and second switches 421, 422 and is arranged in such a manner that when t he actuator 30 moves towards the first end 11 of the elongated body 10 to actuate the writing unit 20, the second switch 422 is driven to move towards the first switch 421 until the circuit activator 423 contacts with the first and second switches 421, 422 to electrically connect the power source 411 with the IC board 412 so as to activate the illuminator 413.

Figure 3C:
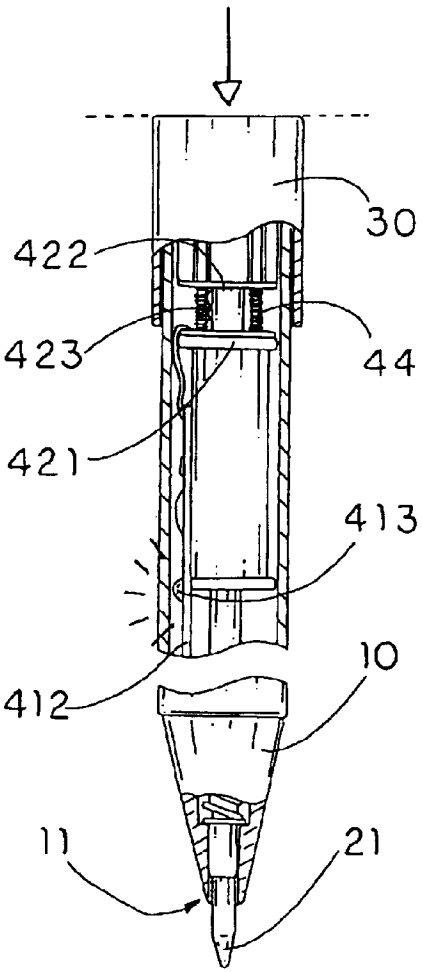
FIGS. 3A through 3C illustrate the positions of the actuator of the illuminable writing instrument to actuate the writing unit and the illumination arrangement according to the above preferred embodiment of the present invention.
Figure 3B:
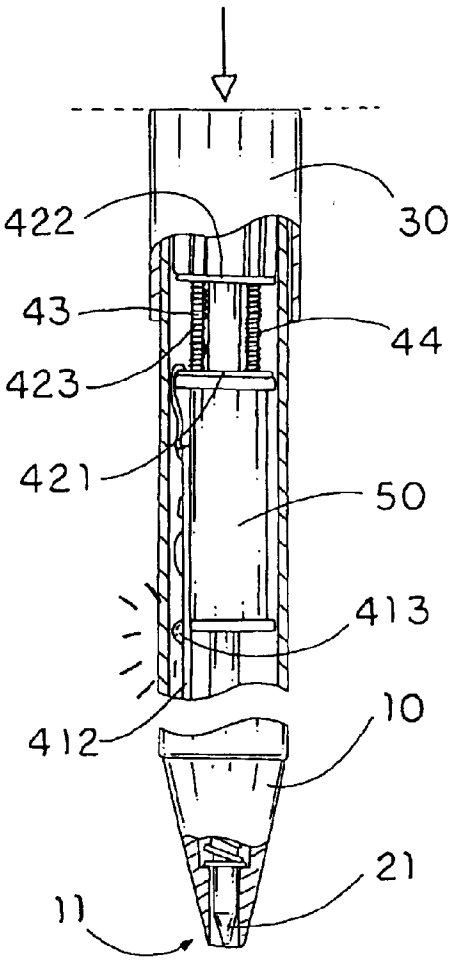
Figure 3A:
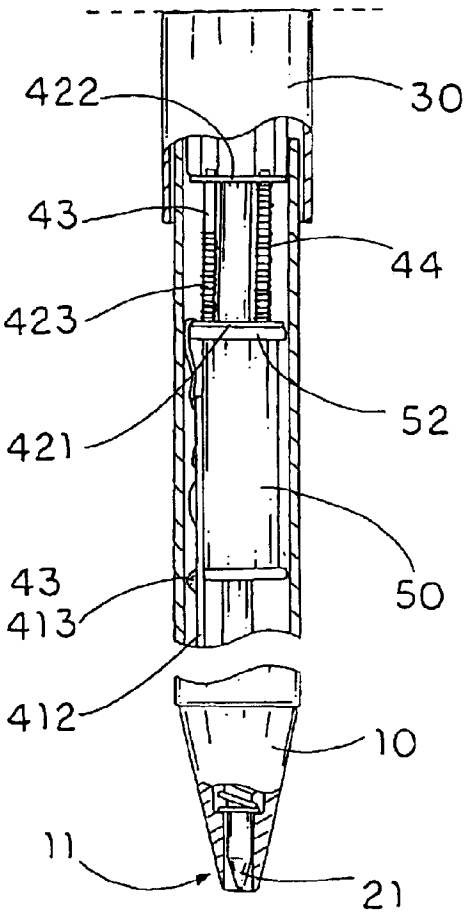

As shown in FIG. 3A, the first switch 421 is supported on a top platform 52 of the supporting member 50 that facing towards the second switch 422 wherein the circuit activator 423 has two ends pointing at the first and second switches 421, 422 respectively, in such a manner that when the second switch 422 is driven to move towards the first switch 421, the two ends of the circuit activator 423 are in contact with the first and second switches 421, 422 respectively, so as to activate the illuminator 413.

The circuit activator 423, according to the preferred embodiment, is a compression spring vertically disposed within the receiving cavity 13 of the elongated body 10 at a position between the first and second switches 421, 422 wherein the compression spring of the circuit activator 423 is arranged to be compressed at the two ends thereof by the first and second switches 421, 422 to activate the illuminator 413 when the actuator 30 drives the second switch 422 moving towards the first switch 421.

The compression spring of the circuit activator 423 has a predetermined length that the two ends of the circuit activator 423 contact with the first and second switches 421, 422 respectively to activate the illuminator 413 when the actuator 30 drives the writing unit 20 between the operation position and the unemployed position. FIG. 3A illustrates the writing unit 20 is positioned at the unemployed position that the first and second switches 421, 422 are electrically disconnected with each other via the circuit activator 423. FIG. 3B illustrates that when the pressing force is applied on the actuator 30 to drive the writing unit 20 from the unemployed position to the operation position, the first and second switches 421, 422 are electrically connected through the circuit activator 423 to activate the illuminator 413. While the pressing force is keep applying on the actuator 30 until the writing unit 20 reaches its operation position, the first and second switches 421, 422 will also be electrically connected through the circuit activator 423 to activate the illuminator 413, as shown in FIG. 3C.

It is worth to mention that the user is able to selectively activate the illuminator 413 only by applying the pressing force on the actuator 30 until the first and second switches 421, 422 are electrically connected through the circuit activator 423 while the writing unit 20 is remained at its unemployed position. Or, the user can both activate the illuminator 413 and actuate the writing unit 20 at the same time by applying the pressing force on the actuator 30 until the writing unit 20 is driven to the operation position. In other words, the illuminable writing instrument of the present invention requires a simple single-action operation to actuate either the illuminator 413 only or both the writing unit and the illuminator 413 at the same time, so as to facilitate the practical use of the present invention.

According to the preferred embodiment, the illumination arrangement 40 further comprises a guiding arm 43 upwardly extended from the first switch 421 to slidably couple with the second switch 422 wherein the circuit activator 423 is coaxially mounted around the guiding arm 43 so as to securely hold the circuit activator 423 at a position between the first and second switches 421, 422.

The illumination arrangement 40 further comprises a retaining unit 44 which comprises at least a retaining arm 441 upwardly extended from the first switch 421 to slidably mount to the second switch 422 and at least a resilient element 442 which is mounted at the retaining arm 441 and has two ends biasing against the first and second switches 421, 422 respectively for applying an urging against the second switch 422 to push the second switch 422 apart from the first switch 421.

For operating the illuminable writing instrument, the user is optional to actuate the writing unit 20 while the illuminator 413 is activated to produce the lighting effect. Accordingly, exertion of relatively small pressing force on the actuator 30 causes the electrical connection between the first and second switches 421, 422 via the circuit activator 423 to activate the illuminator 413 and results in the illumination of the illuminator 413 for a predetermined period of time. In addition, exertion of relatively large pressing force on the actuator 30 causes both the electrical connection of the illuminating unit 41 and the actuation of the writing unit 20, so as to activate the illuminator 413 and to drive the writing unit 20 to the operation position.

Figure 4:
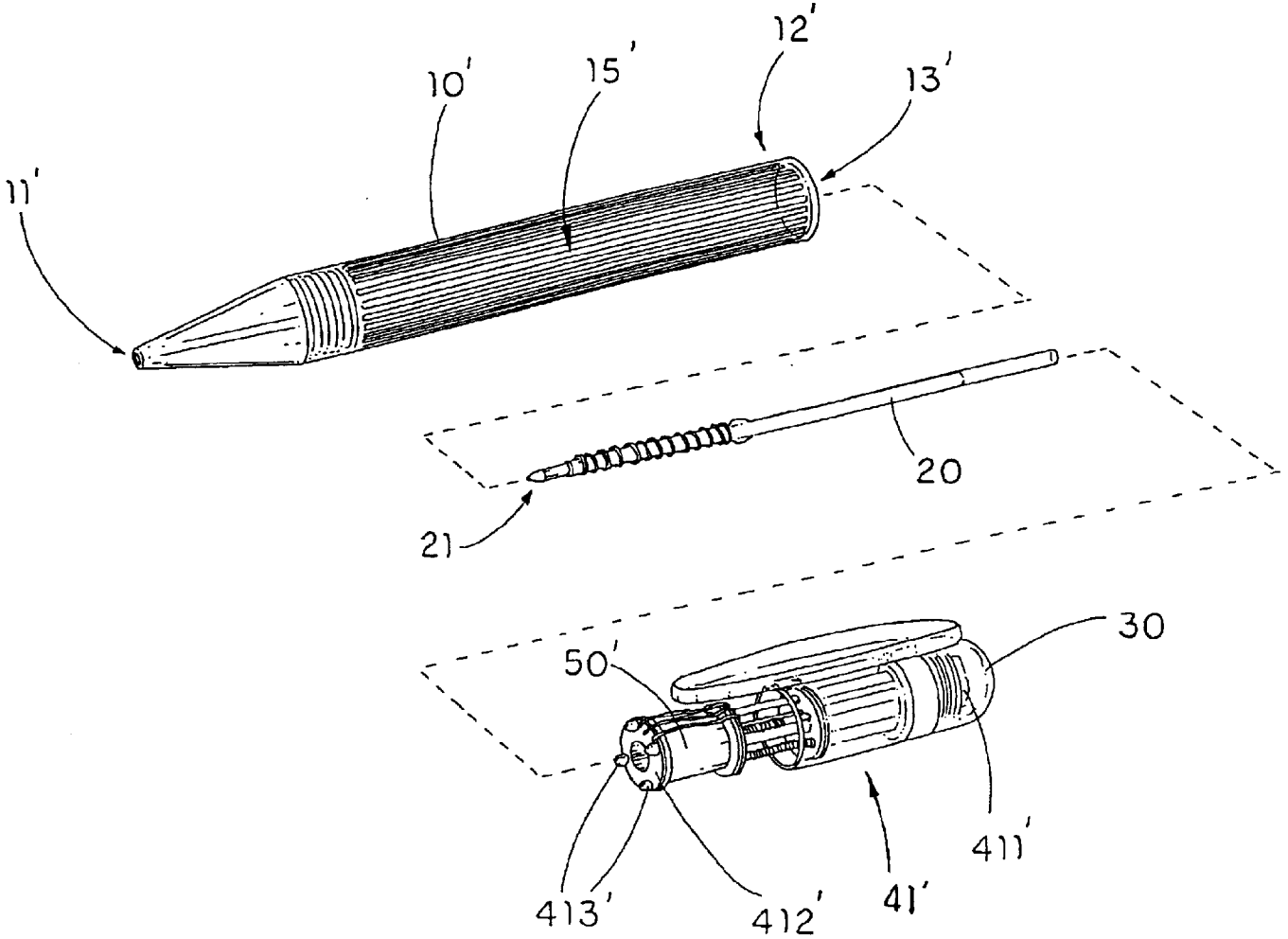
FIG. 4 illustrates an alternative mode of the illuminable writing instrument according to the above preferred embodiment of the present invention.

FIG. 4 illustrates an alternative mode of the illuminating unit 41' which comprises a power source 411' received in the receiving cavity 13' of the elongated body 10' at the second end 12' thereof, an IC board 412' supported within the receiving cavity 13' of the elongated body 10' to electrically connect to the power source 411', and an illuminator 413' electrically mounted on the IC board 412' in such a manner that when the illuminating unit 41' is activated, the illuminator 413' is arranged for producing the lighting effect throughout the elongated body 10'.

The IC board 412', having a ring shape, coaxially mounted around the supporting member 50' within the receiving cavity 13' wherein there are a plurality of illuminators 413' mounted on the IC board 412' in an outwardly radial manner.

As shown in FIG. 4, the elongated body 10' further has a plurality of light guiding channels 15' spacedly formed on an inner circumferential surface and extended towards the first end 11' of the elongated body 10' wherein the light guiding channels 15'are capable of guiding the lights produced by the illuminators 413' to diffuse towards the first end 11' of the elongated body 10' so as to guide the lighting effect throughout the elongated body 10'.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is Claimed is:

1. An illuminable writing instrument, comprising:

a hollow elongated body having a first end, an opposed second end, and a receiving cavity, wherein said elongated body is adapted for a light passing from said receiving cavity to outside;

a writing unit, having a writing tip, disposed in said receiving cavity of said elongated body;

an actuator mounted at said second end of said elongated body to move said writing unit from a normal unemployed position that said writing tip of said writing unit is received within said receiving cavity to an operation position that said writing tip of said writing unit is pushed out of said elongated body at said first end thereof; and an illumination arrangement comprising an illuminating unit supported within said receiving cavity of said elongated body and a switch control which is electrically connected to said illuminating unit and is arranged to activate said illuminating unit for providing a lighting effect throughout said elongated body while actuating said writing unit via said actuator, wherein said illuminating unit comprises a power source received in said receiving cavity of said elongated body at said second end thereof, an IC board supported within said receiving cavity of said elongated body to electrically connect to said power sources, and at least an illuminator electrically mounted on said IC board in such a manner that when said illuminating unit is activated via said switch control, said illuminator is arranged for producing said lighting effect throughout said elongated body, wherein said IC board, having a predetermined length, is positioned within said receiving cavity of said elongated body between said first and second ends thereof for diffusing said lighting effect throughout said elongated body.

2. An illuminable writing instrument, as recited in claim 1, wherein said switch control comprises a first switch securely supported within said receiving cavity of said elongated body to electrically connect with said IC board, a second switch mounted at a bottom side of said actuator to electrically connect with said power source, and a circuit activator which is supported between said first and second switches and is arranged in such a manner that when said actuator moves towards said first end of sad elongated body to actuate said writing unit, said second switch is driven to move towards said first switch until said circuit activator contacts with said first and second switches to electrically connect said power source with said IC board so as to activate said illuminator.

3. An illuminable writing instrument as recited in claim 2, wherein said circuit activator comprises a compression spring vertically disposed within said receiving cavity of said elongated body at a position between said first and second switches, wherein said compression spring of said circuit activator is arranged to be compressed by said first and second switches to activate said illuminator when said actuator drives said second switch moving towards said first switch.

4. An illuminable writing instrument, as recited in claim 3, wherein said illumination arrangement further composes a guiding arm upwardly extended from said first switch to slidably couple with said second switch, wherein said circuit activator is coaxially mounted around said guiding arm so as to securely hold said circuit activator at a position between said first and second switches.

5. An illuminable writing instrument, as recited in claim 3, wherein said illumination arrangement further comprises at least a retaining arm upwardly extended from said first switch to slidably mount to said second switch, and at least a resilient element which is mounted at said retaining arm and has two ends biasing against said first and second switches respectively for applying an urging pressure against said second switch to push said second switch apart from said first switch.

6. An illuminable writing instrument, as recited in claim 3, wherein said circuit activator has a predetermined length that two ends of said circuit activator contact with said first and second switches to activate said illuminator when said actuator drives said writing unit between said operation position and said unemployed position.

7. An illuminable writing instrument, as recited in claim 6, wherein said illumination arrangement further comprises a guiding arm upwardly extended from said first switch to slidably couple with said second switch, wherein said circuit activator is coaxially mounted around said guiding arm so as to securely hold said circuit activator at a position between said first and second switches.

8. An illuminable writing instrument, as recited in claim 7, further comprising a supporting member, having through slot, coaxially supported in said receiving cavity of said elongated body between said first and second thereof to substantially support said IC board in position, wherein a rear portion of said writing unit is slidably passed through said through slot to bias against said actuator and said first switch is mounted on a top platform of said supporting member.

9. An illuminable writing instrument, as recited in claim 8, wherein said illumination arrangement further comprises at least a retaining arm upwardly extended from said first switch to slidably mount to said second switch, and at least a resilient element which is mounted at said retaining arm and has two ends biasing against said first and second switches respectively for applying an urging pressure against said second switch to push said second switch apart from said first switch.

10. An illuminable writing instrument, as recited in claim 7, wherein said illumination arrangement further comprises at least a retaining arm upwardly extended from said first switch to slidably mount to said second switch, and at least a resilient element which is mounted at said retaining arm and has two ends biasing against said first and second switches respectively for applying an urging pressure against said second switch to push said second switch apart from said first switch.

11. An illuminable writing instrument, as recited in claim 6, further comprising a supporting member, having through slot, coaxially supported in said receiving cavity of said elongated body seen said first and ends thereof to substantially support said IC board in position, wherein a rear portion of said writing unit is slidably passed through said through slot to bias against said actuator and said first switch is mounted on a top platform of said supporting member.

12. An illuminable writing instrument, as recited in claim 2, wherein said illumination arrangement further comprises a guiding arm upwardly extended from said first switch to slidably couple with said second switch, wherein said circuit activator is coaxially mounted around said guiding arm so as to securely hold said circuit activator at a position between said first and second switches.

13. An illuminable writing instrument, as recited in claim 2, further comprising a supporting member, having through slot, coaxially supported in said receiving cavity of said elongated body between said first and second ends thereof to substantially support said IC board in position, wherein a rear portion of said writing unit is slidably passed through said through slot to bias against said actuator and said first switch is mounted on a top platform of said supporting member.

14. An illuminable writing instrument, comprising:

a hollow elongated body having a first end, an opposed second end, and a receiving cavity, wherein said elongated body is adapted for a light passing from said receiving cavity to outside;

a writing unit, having a writing tip, disposed in said receiving cavity of said elongated body;

an actuator mounted at said second end of said elongated body to move said writing unit from a normal unemployed position that said writing tip of said writing unit is receiving within said receiving cavity to an operation position that said writing tip of said writing unit is pushed out of said elongated at said first end thereof; and an illumination arrangement comprising an illuminating unit supported within said receiving cavity of said elongated body and a switch control which is electrically connected to said illuminating unit and is arranged to activate said illuminating for providing a lighting effect throughout said elongated body while actuating said writing unit via said actuator, wherein said illuminating unit comprises a power source receiving in said receiving cavity of said elongated body at said second end thereof, an IC board supported within said receiving cavity of said elongated body to electrically connect to said power source, and at least an illuminator electrically mounted on said IC board in such a manner that when said illuminating unit is activated via said switch control, said illuminator is arranged for producing said lighting effect throughout said elongated body, wherein said switch control comprises a first switch securely supported within said receiving cavity of said elongated body to electrically connected with said IC board, a second switch mounted at a bottom side of said actuator to electrically connect with said power source, and a circuit activator which is supported between said first and second switches and is arranged in such a manner that when said actuator moves towards said first end of said elongated body to actuate said writing unit, said second switch is driven to move towards said first switch unit said circuit activator contacts with said first and switches to electrically connect said power source with said IC board so as to activate said illuminator, wherein said circuit activator has a predetermined length that two ends of said circuit activator contact with said first and second switches to activate said illuminator when said actuator drives said writing unit between sold operation position and said unemployed position.

15. An illuminable writing instrument, comprising:

a hollow elongated body having a first end, an opposed second end, and a receiving cavity, wherein said elongated body is adapted for a light passing from said receiving cavity to outside;

a writing unit, having a writing tip, disposed in said receiving cavity of said elongated body;

an actuator mounted at said second end of said elongated body to move said writing unit from a normal unemployed position that said writing tip of said writing unit is receiving within said receiving cavity to an operation position that said writing tip of said writing unit is pushed out of said elongated body at said first and thereof; and an illumination arrangement comprising an illuminating unit supported within said receiving cavity of said elongated body and a switch control which is electrically connect to said illuminating unit and is arranged to activate said illuminating unit for providing a lighting effect throughout said elongated body while actuating said writing unit via said actuator, wherein said illuminating unit comprises a power source received in said receiving cavity of said elongated body at said second end thereof, an IC board supported within said receiving cavity of said elongated body to electrically connect to said power source, and at least an illuminator electrically mounted on said IC board in such a manner that when said illuminating unit is activated via said switch control, said illuminator is arranged for producing said lighting effect throughout said elongated body, wherein said switch control comprises a first switch securely supported within said receiving cavity of said elongated body to electrically connect with said IC board, a second switch mounted at a bottom side of said actuator to electrically connect with said power source, and a circuit activator which is supported between said first and second switches and is arranged in such a manner that when said actuator moves towards said first end of said elongated body to actuate said writing unit, said second switch is driven to move towards said first switch until said circuit activator contacts with said first and second switches to electrically connect said power source with said IC board so as to activate said illuminator, wherein said circuit activator comprises a compression spring vertically disposed within said receiving cavity of said elongated body at a position between said first and second switches, wherein said compression spring of said circuit activator is arranged to be compressed by said first and second switches to active said illuminator when said actuator drives said second switch moving towards said first switch, wherein said circuit activator has a predetermined length that two ends of said circuit activator contact with said first and second switches to activate said illuminator when said actuator drives said writing unit between said operation position and said unemployed position.

16. An illuminable writing instrument, comprising:

a hollow elongated body having a first end, an opposed second end, and a receiving cavity, wherein said elongated body is adapted for a light passing from said receiving cavity to outside, wherein said elongated body further has a plurality of light guiding channels spacedly formed on an inner circumferential surface and extended towards said first end of said elongated body, a writing unit, having a writing tip, disposed in said receiving cavity of said elongated body;

an actuator mounted at said second end of said elongated body to move said writing unit from a normal unemployed position that said writing tip of said writing unit is received within said receiving cavity to an operation position that said writing tip of said writing unit is pushed out of said elongated body at said first end thereof; and an illumination arrangement comprising an illuminating unit supported within said receiving cavity of said elongated body and a switch control which is electrically connected to said illuminating unit and is arranged to activate said illuminating unit for providing a lighting effect throughout said elongated body while actuating said writing unit via said actuator, wherein said illuminating unit comprises a power sources received in said receiving cavity of said elongated body at said second end thereof, an IC board supported within said receiving cavity of said elongated body to electrically connect to said power source, and at least an illuminator electrically mounted on said IC board in such a manner that when said illuminating unit is activated via said switch control, said illuminator is arranged for producing said lighting effect throughout said elongated body, wherein each of said light guiding channels is capable of guiding said light produce by said illuminator to diffuse towards said first end of said elongated body so as to guide said light effect throughout said elongated body.

17. An illuminable writing instrument as recited in claim 16, wherein said switch control comprises a first switch securely supported within said receiving cavity of said elongated body to electrically connect with said IC board, a second switch mounted at a bottom side of said actuator to electrically connect with said power source, and a circuit activator which is supported between said first and second switches and is arranged in such a manner that when said actuator moves towards said first end of said elongated body to actuate said writing unit, said second switch is driven to move towards said first switch until said circuit activator contacts with said first and second switches to electrically connect said power source with said IC board so as to activate said illuminator.

18. An illuminable writing instrument as recited in claim 17, wherein said circuit activator comprises a compression spring vertically disposed within said receiving cavity of said elongated body at a position between said first and second switches, wherein said compression spring of said circuit activator is arranged to be compressed by said first and second switches to activate said illuminator when said actuator drives said second switch moving towards said first switch.

19. An illuminable writing instrument, as recited in claim 18, wherein said circuit activator has a predetermined length that two ends of said circuit activator contact with said first and second switches to activate said illuminator when said actuator drives said writing unit between said operation on and said unemployed position.

* * * * *